United States Patent [19]

Uehara et al.

[11] 4,230,179

[45] Oct. 28, 1980

[54] PLATE TYPE CONDENSERS

[75] Inventors: Haruo Uehara, Saga; Michizo Miyoshi, Yokohama, both of Japan

[73] Assignees: Haruo Uehara; Tokyo Shibaura Denki Kabushiki Kaisha, both of Japan

[21] Appl. No.: 55,779

[22] Filed: Jul. 9, 1979

Related U.S. Application Data

[63] Continuation of Ser. No. 809,766, Jun. 24, 1977, abandoned.

[51] Int. Cl.[3] ..... F28B 9/08

[52] U.S. Cl. ..... 165/113; 165/167

[58] Field of Search ..... 165/110, 111, 113, 166, 165/167, 170

[56] References Cited

U.S. PATENT DOCUMENTS

| | | | |
|---|---|---|---|
| 2,285,225 | 6/1942 | Norris | 165/166 |
| 2,587,116 | 2/1952 | Clay | 165/170 |
| 2,596,642 | 5/1952 | Boestad | 165/166 |
| 3,783,090 | 1/1974 | Anderson et al. | 165/166 |
| 3,840,070 | 10/1974 | Becker et al. | 165/110 |
| 3,862,661 | 1/1975 | Kovalenko et al. | 165/166 |

FOREIGN PATENT DOCUMENTS

| | | | |
|---|---|---|---|
| 1395013 | 5/1975 | United Kingdom | 165/166 |

OTHER PUBLICATIONS

Heat Management and Pollutions Control, vol. 28, No. 9, Aug. 30, 1976, pp. 1-6.

*Primary Examiner*—Sheldon Richter
*Attorney, Agent, or Firm*—Stevens, Davis, Miller & Mosher

[57] ABSTRACT

A plate type condenser is constituted by a primary condensation section and a secondary condensation section positioned on the downstream side of the primary condenser. The primary condenser comprises a plurality of condensation elements and a plurality of condensate discharge grooves extending along respective condensation elements and inclined in the form of a herringbone with respect to the passages which pass a heated medium to be condensed and a medium to be heated in opposite directions.

6 Claims, 7 Drawing Figures

PLATE TYPE CONDENSERS

This is a continuation of application Ser. No. 809,766, filed June 24, 1977, now abandoned.

BACKGROUND OF THE INVENTION

This invention relates to an improvement of a plate type condenser of the type wherein heated medium is condensed by a medium to be heated.

In an electric power generating plant wherein an operating medium such as steam is circulated through a steam turbine or a chemical plant for refining substances a condenser is generally used. Condensers used in such plants ordinary comprise a group of circular tubes having smooth inner surfaces and arranged in a horizontal or vertical direction. In some cases, the tubes are provided with fins on their periphery to improve the rate of heat exchange.

Improvement of the efficiency in such a condenser has been difficult for the following reasons:

1. Where the tubes are arranged horizontally, since the heated medium flows sinuously for the purpose of improving the efficiency of heat exchange between the heated medium and the medium to be heated, the pressure loss is large. Moreover, due to poor heat conductivity and rate of heat transfer only about one half of the tubes contribute to heat transfer.

2. Where the tubes are arranged vertically the thickness of the condensed medium increases toward the lower ends of the tubes thus decreasing heat transfer.

3. In addition, as it is necessary to drill a plurality of openings through header plates, a large number of steps for machining and assembling the condenser are required.

4. Where a plurality of tubes are vertically assembled with a small spacing therebetween, the heated medium condenses at a relatively high speed and efficiency at the upper portion of the heat transfer surface, but this is accompanied by a large pressure drop. On the other hand, at the lower portion of the heat transfer surface the flow speed of the heated medium is low because a substantial portion thereof has already been condensed at the upper portion. Accordingly, the pressure loss is small but the efficiency of condensation is greatly decreased because the condensate formed at the upper portion flows downwardly.

Accordingly there has been a great demand for an improved condenser that can eliminate various difficulties described above.

SUMMARY OF THE INVENTION

It is an object of this invention to provide an improved plate type condenser capable of operating at high efficiencies by the unique utilization of the surface tension of the condensate.

Another object of the invention is to provide an improved plate type condenser having simple construction and a small pressure drop.

According to this invention there is provided a plate type condenser of the type wherein a plurality of spaced metal plates are arranged to define a plurality of passages therebetween and heated medium to be condensed and medium to be heated thereby are passed through the passages in opposite directions, characterized in that the condenser comprises a primary condensation section including a plurality of condensation elements and a plurality of condensate discharge grooves extending along respective condensation elements and inclined with respect to the passages, and a secondary condensation section positioned on the downstream side of the primary condensation section for condensing the heated medium not condensed by the primary condensation section.

Preferably, the primary condensation section takes the form of a herringbone pattern and the secondary condensation section the form of a corrugated plate to form a plurality of spaced vertical condensate reservoirs or passages. The condensate in these passages acts to collect the condensate by surfce tension thus enhancing condensation.

BRIEF DESCRIPTION OF THE DRAWINGS

The invention will now be described in detail with reference to the accompanying drawings in which.

DESCRIPTION OF THE PREFERRED EMBODIMENTS

Figure 1:
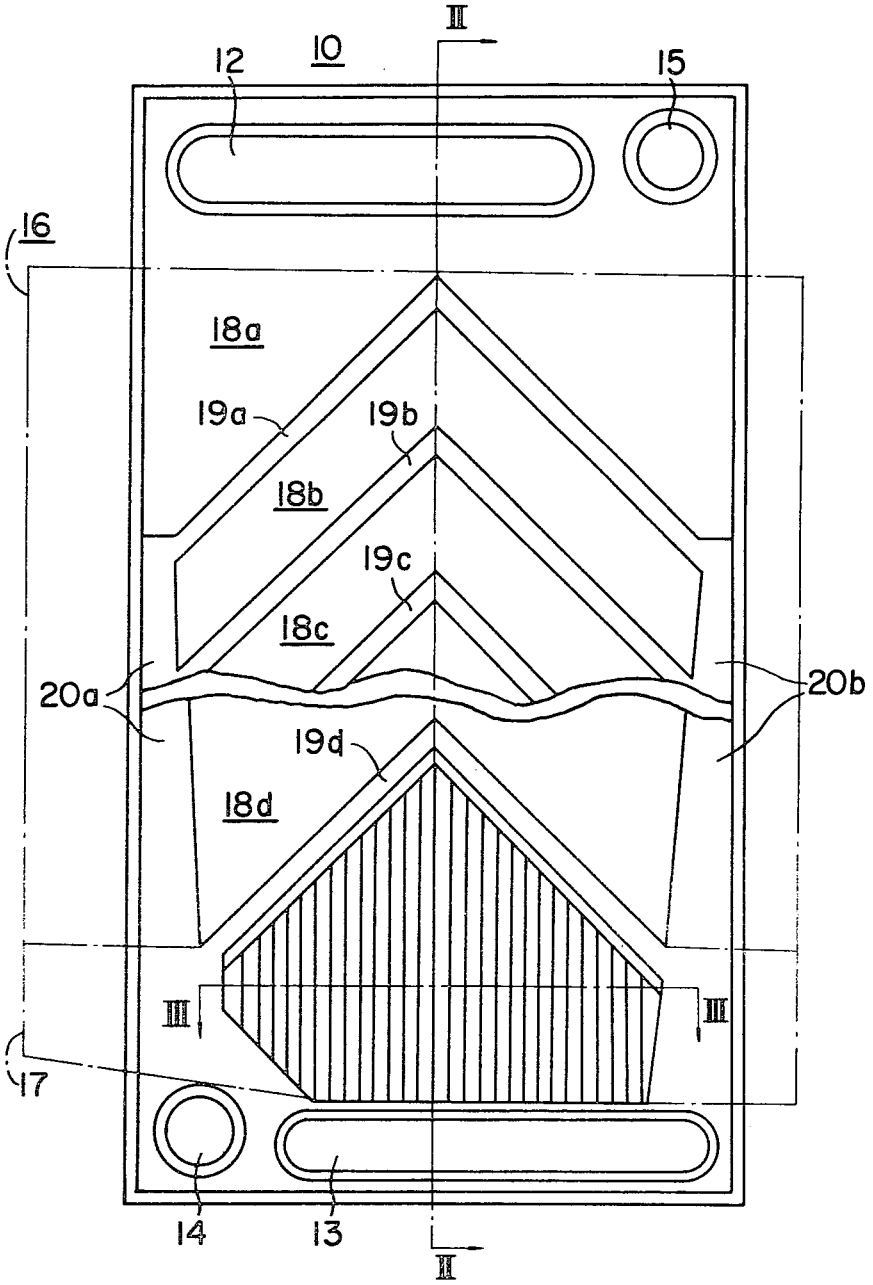
FIG. 1 is a longitudinal sectional view of a plate type condenser embodying the invention.

Referring now to FIG. 1 of the accompanying drawings a condenser 10 shown therein is made of metal plates and comprises an inlet port 12 near its upper end for admitting heated medium to be condensed such as steam, a discharge port 13 near the lower end for discharging the condensate, an inlet port 14 near the lower end and a discharge port 15 near the upper end which are used to circulate a medium to be heated through the condenser, a primary condensation section 16 for condensing the heated medium by the medium to be heated at portions where the flow speed of the heated medium is high and a secondary condensation section 17 located on the downstream side for condensing remaining heated medium by the efficient use of the surface tension.

As shown, the primary condensation section 16 is constituted by a plurality of condensation elements 18*a* through 18*d* which are disposed in a herringbone pattern and a plurality of condensate discharge grooves 19*a* through 19*d* respectively extending along the lower edges of the condensation elements. Thus, each groove is triangular with its apex directed upwardly. On both sides of the condensation elements and the condensate discharge grooves are disposed vertical downcomers 20*a* and 20*b* for conveying the condensate.

Figure 2:
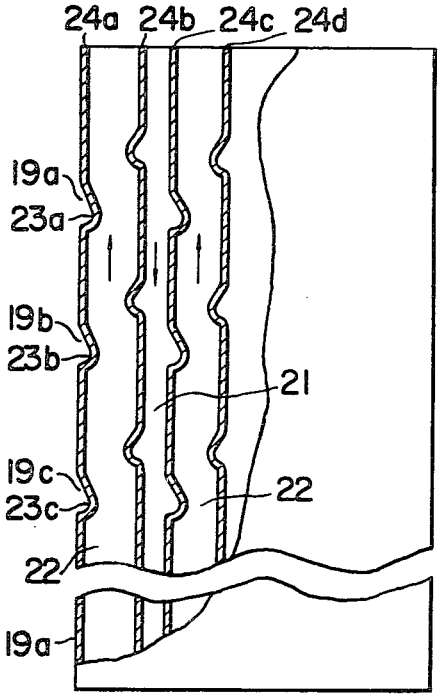
FIG. 2 is a partial sectional view of the condenser shown in FIG. 1 taken along a line II—II and showing the detail of the primary condensation section.

The detail of the condensate discharge grooves 19*a* through 19*d* will now be described with reference to FIG. 2 in which the passages for the heated medium are designated by a reference numeral 21 whereas the passages for the medium to be heated by 22. These passages 21 and 22 are defined by metal plates 24*a*, 24*b*, 24*c* and 24*d* each provided with the condensate discharge grooves 19*a* through 19*d*. The upper end of each groove is shaped to have a smooth curved surface so that the condensate can flow into the groove by gravity and surface tension whereas the lower ends of the grooves are terminated with recesses 23*a*, 23*b* and 23*c* which are shaped to prevent the condensate from entering into to subsequent condensation elements.

Figure 3:
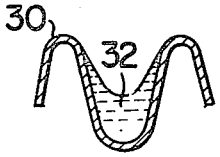
FIG. 3 is a partial sectional view taken along a line III—III in FIG. 1 and showing the detail of one form of the secondary condenser.
Figure 4:
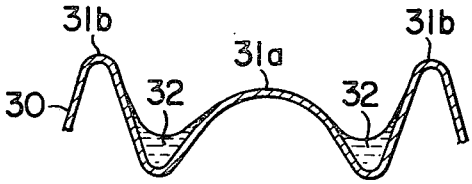
FIGS. 4 and 5 are partial sectional views showing modified secondary condensers.
Figure 5:
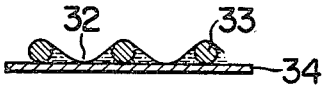

The secondary condensation section 17 comprises a central or low condensation element 31*a* and high condensation elements 31*b* both acting to condense the heated medium which has not been condensed by the condensation elements 18*a* through 18*d* or, once condensed by the condensation elements 18*a* through 18*d*, evaporated again while flowing down through the downcomers 20*a* and 20*b*, and condensate reservoirs or passage 32 between the high and low corrugations of the condensation elements 31*b* and 31*a* for receiving and guiding the condensate therefrom, as shown in FIG. 4. The condensation elements 31*a* and 31*b* and the condensate reservoirs 32 can be formed by suitably bending a metal plate 30. Since the cross-sectional configuration of the secondary condensation section 17 is determined dependent upon the type of the medium to be condensed and the operating conditions of the condenser, the cross-sectional configuration may take various forms. Thus, for example, in the example shown in FIG. 3 corrugated metal plate 30 not provided with the low condensation element 31*a* is used whereas in the example shown in FIG. 5 spaced metal rods 33 are secured to a metal plate 34.

In operation, the heated medium to be condensed admitted into the heat exchangeer through the inlet port 12 undergoes heat exchange with the medium to be heated supplied through the inlet port 14 at successive condensation elements 18*a* through 18*d* of the first condensation section 16 whereby most of the heated medium is condensed. Remaining or not condensed heated medium is conveyed to the secondary condensation section 17. At this time, since the velocity of the heated medium is very small the condensate will be gathered in the condensate reservoirs 32 shown in FIGS. 3, 4 or 5 by the surface tension. The condensate collected in the reservoirs 32 flows downwardly by the action of gravity, and is then discharged to the outside of the condenser through discharge port 13 together with the condensate from the downcomers 20*a* and 20*b*. With the condenser described above it is possible to condense heated medium at higher efficiencies than the prior art circular tube type condenser. More particularly, the provision of both primary condensation section and secondary condensation section results inthe following advantages.

1. In the primary condensation section since the velocity of the medium to be condensed is sufficiently high, the condensate is pulled by the frictional force between it and the vapour phase medium so that the condensate spreads to form a thin film thus increasing the efficiency of condensation. Moreover, as the axial length of this section is relatively short and since condensate discharge grooves are provided the pressure loss caused by this section is relatively small.

2. Although the secondary condensation section does not manifest as strong a condensing effect as the primary condensation section, it is possible to expect a larger condensing effect than that of the prior art condenser by the unique utilization of the surface tension of the condensate. Moreover as the condensate reservoirs extend in the vertical direction, discharge of the condensate is enhanced thus increasing the efficiency of condensation.

Figure 6A:
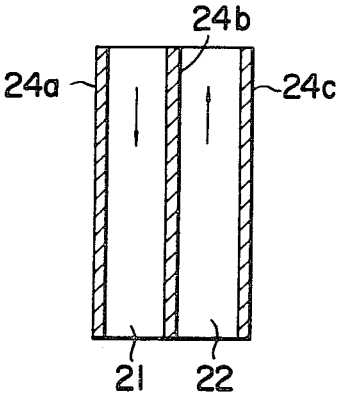
FIGS. 6*a* and 6*b* are sectional views showing different arrangement of the plates.
Figure 6B:
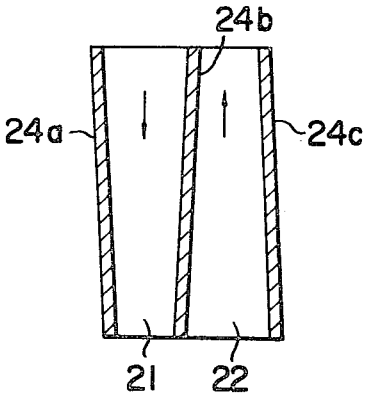

FIGS. 6*a* and 6*b* show two different arrangements of the plates 24*a*, 24*b* and 24*c* for defining passages 21 and 22 for passing the medium to be condensed and the medium to be heated respectively. In the case shown in FIG. 6*a*, all plates are parallel whereas in the case shown in FIG. 6*b* the intermediate plate 24*b* is inclined. With this construction the sectional area of the passage 21 decreases gradually toward the lower end of condenser because the volume of the medium to be condensed decreases as the condensation proceeds. Similarly the sectional area of the passage 22 is gradually decreased toward the upper end of condenser for the purpose of increasing the velocity of the medium to be heated.

What is claimed is:

1. In a plate type condenser of the type wherein a plurality of spaced metal plates are arranged to define a plurality of passages therebetween and heated medium to be condensed and medium to be heated thereby are passed through said passages in the opposite directions, the improvement which comprises a primary condensation section including a plurality of condensation elements and a plurality of condensate discharge grooves formed in said metal plate and extending along respective condensation elements and inclined with respect to said passages, said condensate discharge grooves being spaced from each other in the direction of flow of said heated medium and said medium to be heated by flat portions of said metal plates which do not protrude into the passage passing said medium to be heated, said condensate discharge grooves having a cross-sectional configuration which only protrudes into the passage passing said medium to be heated, and a secondary condensation section positioned on the downstream side of said primary condensation section for condensing the heated medium not condensed by said primary condensation section.

2. The plate type condenser according to claim 1 wherein said condensation elements and said condensate discharge grooves of the primary condensation section are arranged in a herringbone pattern.

3. The plate type condenser according to claim 1 wherein said secondary condensation section comprises a metal plate formed with a plurality of spaced vertical condensate reservoirs.

4. The plate type condenser according to claim 3 wherein said metal plate of said secondary condensation section is corrugated.

5. The plate type condenser according to claim 4 wherein said corrugated plate has alternate high and low corrugations and said condensate reservoirs are defined between said high and low corrugations.

6. In a plate type condenser of the type wherein a plurality of spaced metal plates are arranged to define a plurality of passages therebetween and a heated medium to be condensed and a medium to be heated thereby are passed through said passages in opposite directions, the improvement which comprises a vertically arranged primary condensation section including a plurality of condensation elements and condensate discharge grooves formed in said metal plate and extending along respective condensation elements and inclined with respect to a vertical direction of flow of said heated medium and said medium to be heated passing through said passages, said condensation elements and said condensation discharge grooves being arranged in a herringbone pattern, said condensate discharge grooves being spaced from each other in the direction of flow of said heated medium and said medium to be heated by flat portions of said metal plates which do not protrude into the passage passing said medium to be heated, said condensate discharge grooves having a cross-sectional configuration which only protrudes into the passage passing said medium to be heated, and a secondary condensation section positioned on the downstream side of said primary condensation section for condensing the heated medium not condensed by said primary condensation section, said secondary condensation section comprising a metal plate formed with a plurality of parallel spaced vertical condensate reservoirs.

* * * * *